US005676557A

United States Patent [19]

Jego et al.

[11] Patent Number: 5,676,557

[45] Date of Patent: Oct. 14, 1997

[54] ELECTRICAL TRUNKING AND METHOD OF MANUFACTURING THE SAME

[75] Inventors: Gérard Jego, Brazey en Plaine; Daniel Nourry, Dijon; Jean-Pierre Thierry, Arc sur Tille; Jean-Claude Lebeau, Varois; Philippe Normand, Chevigny, all of France

[73] Assignee: Schneider Electric SA, Boulogne-Billancourt, France

[21] Appl. No.: 404,957

[22] Filed: Mar. 16, 1995

[30] Foreign Application Priority Data

Mar. 17, 1994 [FR] France ..... 94 03251

[51] Int. Cl.[6] ..... H01R 4/60

[52] U.S. Cl. ..... 439/207; 439/216

[58] Field of Search ..... 439/207, 209, 439/211, 214, 216, 120, 110, 113

[56] References Cited

U.S. PATENT DOCUMENTS 1,809,223 6/1931 Tashjian .
4,462,650 7/1984 Humphreys ..... 439/120
4,508,400 4/1985 Herbert ..... 439/207
5,336,097 8/1994 Williamson et al. ..... 439/110

FOREIGN PATENT DOCUMENTS 1 148 184 4/1969 United Kingdom .

*Primary Examiner*—Neil Abrams
*Assistant Examiner*—T. C. Patel
*Attorney, Agent, or Firm*—Oblon, Spivak, McClelland, Maier & Neustadt, P.C.

[57] ABSTRACT

Manufacture of electrical trunking containing, in a metal enclosure, a set of parallel electrical conductors supported at regular intervals on insulative contact blocks. A single sheet metal blank is bent and crimped to produce a tubular profile with joined edges 27, 28, the conductor assembly 31 is then slid into the tube and each support contact block 30 is centered in a respective branch opening 18 using a tool inserted through the opening. The contact block is clamped against the opening by an elastic expansion device.

6 Claims, 4 Drawing Sheets

ELECTRICAL TRUNKING AND METHOD OF MANUFACTURING THE SAME

BACKGROUND OF THE INVENTION

1. Field of the Invention

The present invention concerns a method of manufacturing electrical trunking comprising a metal enclosure and a conductor assembly, wherein the metal enclosure includes branch openings at particular intervals and wherein the conductor assembly is made up of parallel electrical conductors applied at the particular intervals to insulative supporting contact blocks. The invention also concerns prefabricated electrical trunking manufactured by this method.

2. Discussion of the Background

The enclosure of electrical trunking is usually made from a channel-section or from sheet metal that is bent into a shape and either has a cover or is made in two halves, also from sheet metal bent to shape, and fitting together on longitudinal mating planes. To seal the trunking after inserting the conductor assembly the cover must be sealed to it or the two halves must be sealed to each other. Both of these methods can cause problems.

SUMMARY OF THE INVENTION

It is desirable to reduce the unit cost of the trunking by reducing the wall thickness within prescribed stiffness limits and by simplifying its manufacture.

An object of the invention is to reduce the unit cost of electrical trunking having a bent sheet metal enclosure by simplifying its manufacture in such a way as to preserve the electrical and mechanical properties of branch connections.

The invention includes a method of manufacturing electrical trunking including a metal enclosure with branch openings at regular intervals and a conductor assembly accommodated in the enclosure and including parallel electrical conductors applied at regular intervals to insulative support contact blocks, the method comprises the following steps:

- cutting branch openings at regular intervals in a sheet metal blank,
- bending the blank and crimping its longitudinal edges to obtain a tube with sealed and joined edges,
- inserting the conductor assembly into the tube by sliding it along the tube until the support contact blocks are aligned with their respective branch openings, and
- centering the contact blocks and holding them centered relative to their respective branch openings.

The support and branch connection contact blocks are preferably pressed against an inside wall of the tubular enclosure by inserting a tool through the branch opening to expand the contact block and/or brace it against the inside faces of opposite walls of the enclosure.

The invention also includes electrical trucking manufactured by this method, each contact block of which is preferably associated with an elastic clamping member expansion device.

BRIEF DESCRIPTION OF THE DRAWINGS

The following description with reference to the drawings of one embodiment of the invention shows the advantages and characteristics of the invention.

DETAILED DESCRIPTION OF THE PREFERRED EMBODIMENTS

Figure 1:
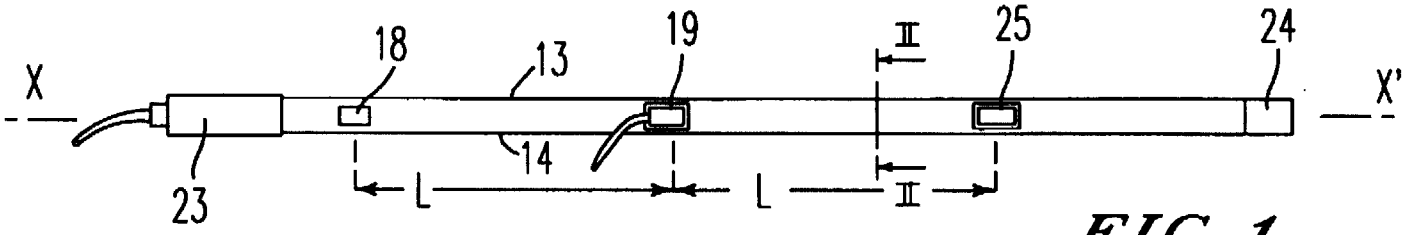
FIG. 1 shows a section of prefabricated electrical trunking of the invention.
Figure 2:
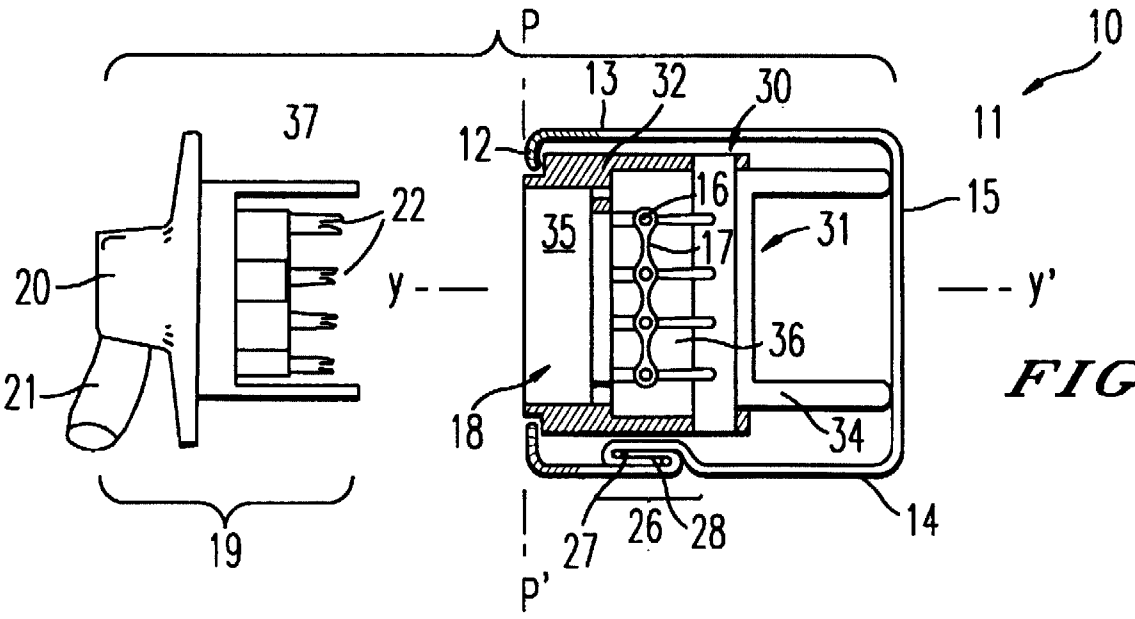
FIG. 2 is an enlarged sectional view on the line II—II in FIG. 1.

The prefabricated electrical trunking 10 shown in FIGS. 1 and 2 is made up of a number of sections of the same length assembled together end-to-end. For simplicity only one section is shown here. Each section of trunking comprises a metal enclosure 11 which has a rectangular cross-section, preferably a square cross-section for optimal stiffness, with four walls 12, 13, 14, 15, accommodating a plurality of electrically conductive busbars or cables 16, in this example a flat bundle 17 of four conductors. Generally rectangular openings 18 are formed in the wall 12 at regular intervals L. The purpose of these openings is to receive branch connectors 19 for supplying loads (not shown) from the conductors 16. The connectors 19 have an insulative body 20, an outlet cable 21 and connecting terminals, for example spring clips 22 which are adapted to fit over bared parts 16*a* of the conductors 16 to make the electrical connection between the latter and the outlet cable. In this example the conductors 16 are sheathed flexible cables but they can equally well comprise bare or sheathed metal strips or busbars.

The trunking 10 has a power supply end-piece 23 at one end and a closure end-piece 24 at the other end. Any openings 18 which are not occupied by connectors can be closed and sealed by caps 25. Clipping means (not shown) provide the mechanical and electrical connection between trunking sections. Fixing members provide the mechanical connection of the trunking to a horizontal or vertical supporting wall and are used to suspend accessories from the trunking.

The enclosure 11 of the trunking is made by bending a sheet metal blank to a closed contour; the free edges 27, 28 of the blank are crimped longitudinally at 26, i.e. the edges are bent to form interengaging U-sections. The sealed crimp seam 26 is on a wall 14 of the enclosure perpendicular to the wall 12 including the branch openings 18 and increases the stiffness of the enclosure. X–X' denotes the axis of the trunking, P–P' denotes the outside face of the wall 12 and Y–Y' denotes the central axis of the opening 18, perpendicular to P–P'. The rectangular external cross-section of the enclosure with no sharp edges provides a neat appearance and good stiffness from relatively thin walls.

The bundle 17 of cable 16 is supported by support contact blocks 30 disposed at regular intervals, identical to the intervals L between the openings 18, in such a way that the cables and their support contact blocks form a conductor subassembly 31 which can be slid into the closed contour tubular enclosure 11 of the trunking along its axis X–X'. Each support contact block is associated with an opening 18 and has an expansion device 30*a* operated through the opening 18 so that it bears against the inside faces of the walls of the enclosure to hold the contact block in position.

The contact block 30 has an insulative body 32 with a flange 33 facing the opening and having a rebated centering edge 33a.

Figure 3:
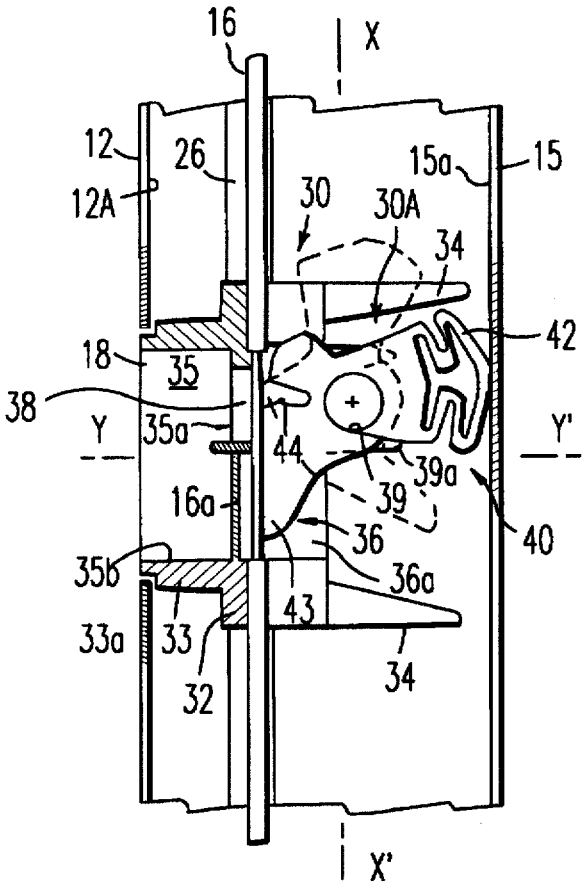
FIG. 3 is a plan view of the area of a branch opening with a support contact block in the clamped position.
Figure 4:
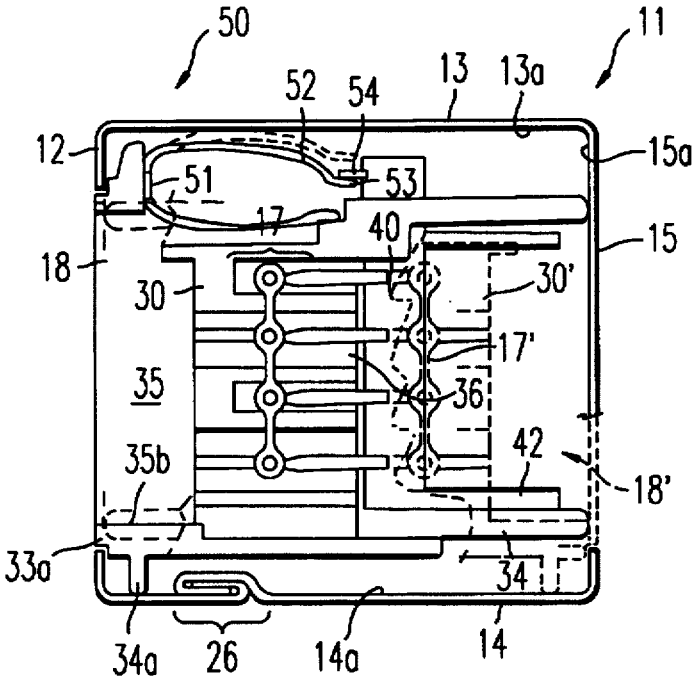
FIG. 4 shows an enlarged sectional view of the enclosure in a manner analogous to FIG. 2.

In the embodiment of the invention shown in FIGS. 3 and 4 the body 32 has legs 34 on the side opposite the opening 18 which can bear on the inside face 15a of the wall 15 during insertion of the subassembly 31 into the tubular enclosure and disengaged from this inside face by clamping the contact block. The body 32 includes a housing 35 for the connector whose back is subdivided into cells 35a and a housing 36 with respective slots 36a for the conductors 16. The side walls 35b of the housing 35 provide guides for the complementary shapes 37 of the connector. The elastic terminals 22 fit over ribs 38. The ribs 38 brace the body 32 between the oppositely facing housings 35, 36; they are thinner than the bared parts 16a of the conductor 16 which are pressed against them in the direction of the opening 18.

The body 32 of the support contact block has bearings 39 with axes perpendicular to X–X' and Y–Y'. The bearings are flanked by lugs 39a and adapted to receive journals or a spindle of a pivoting member 40 which constitutes the expansion device 30a in this example.

The pivoting member 40 has a deformable part 42 with an elastic cam configuration disposed between the legs 34 and adapted to be applied to the inside face 15a of the wall 15. It has rigid bearing branches 43 opposite this cam. When the member 40 pivots, the branches are applied simultaneously in the manner of a comb to the straight bared parts 16a of the conductors 16. The deformable part 42 pivots between a retracted position (shown in dashed outline in FIG. 3) and an expansion position (full outline) which clamps the contact block by means of a tool inserted through the opening 18. It bears on a recess 44 to displace the contact block in the direction Y–Y' towards the opening 18, the rebated edge 33a of the flange 33 being centered in the opening. In the clamped position the outer edge 33a of the contact block is pressed against the edge of the opening and is substantially in the plane P–P' of the outside face 12a of the wall 12; this facilitates mounting the connector 19 by sliding it along the wall 12 until it nests in the housing 35 of the contact block. As can be seen in FIG. 4, the support contact block can have a guide finger 34a on the inside face of the wall 14 between where it joins the wall 12 and the crimped seam 26. On the same side as the wall 13 the support contact block has an elastic contact strip 50 in the form of a loop attached to the contact block at 51; this strip has one branch 52 adapted to earth the enclosure by virtue of contact between one part of the branch and an inside face 13a of the wall 13; during insertion of the contact block the free end 53 of the branch 52 is clamped by a lug 54 attached to the pivoting member; it is released by the lug 54 once the contact block is clamped in position (as shown in dashed outline in FIG. 4).

Figure 5:
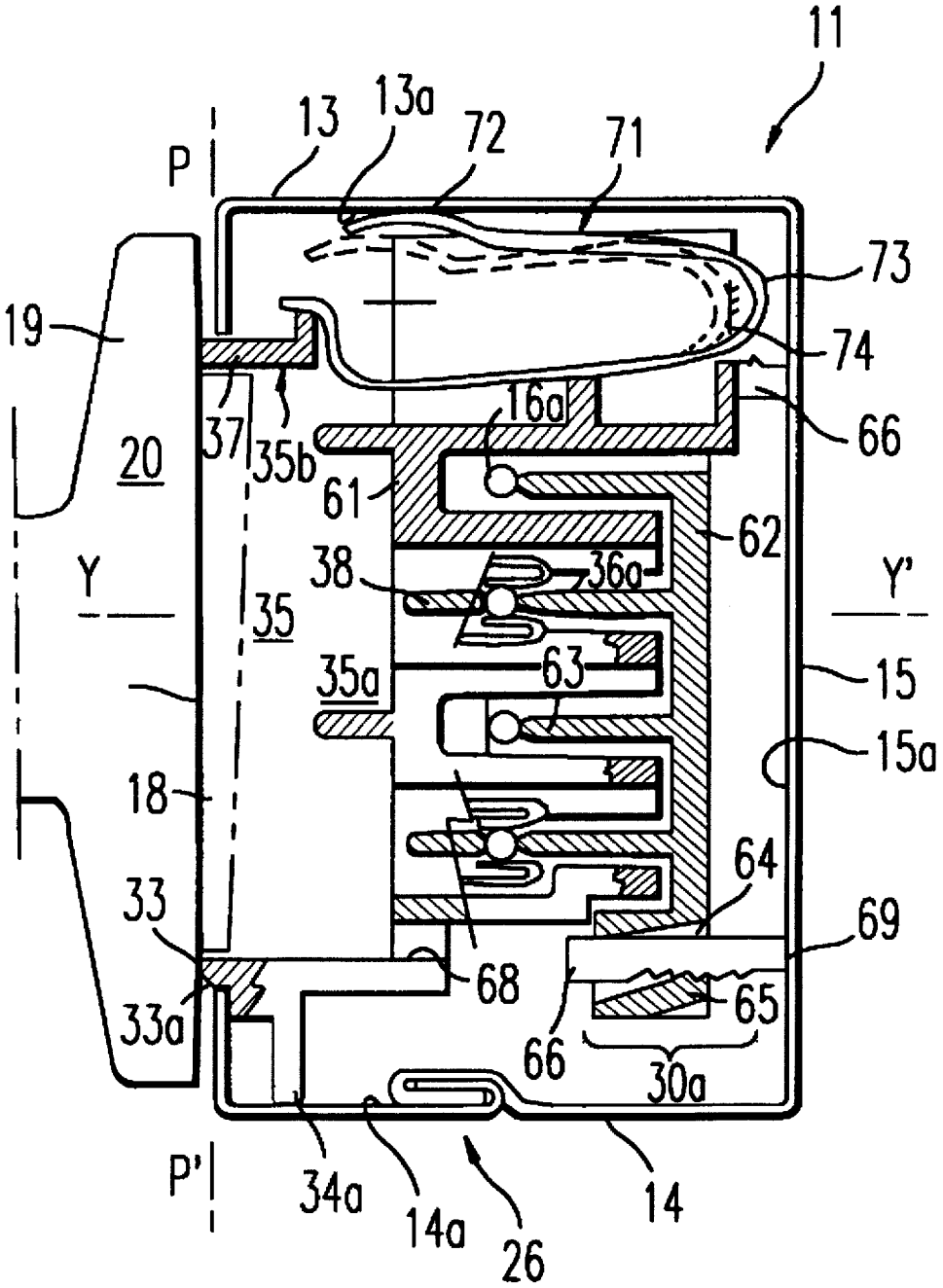
FIG. 5 is another sectional view of the trunking showing a different embodiment of the support contact block.
Figure 6:
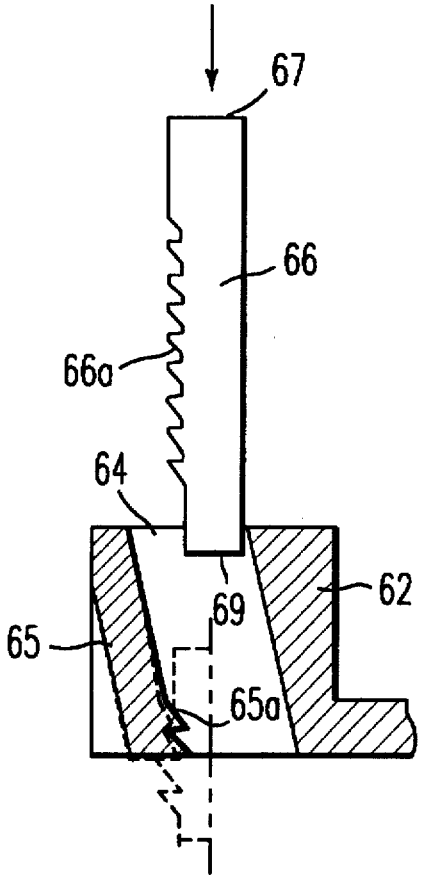
FIG. 6 shows to a larger scale part of the contact block expansion and elastic clamping device from FIG. 5.
Figure 7:
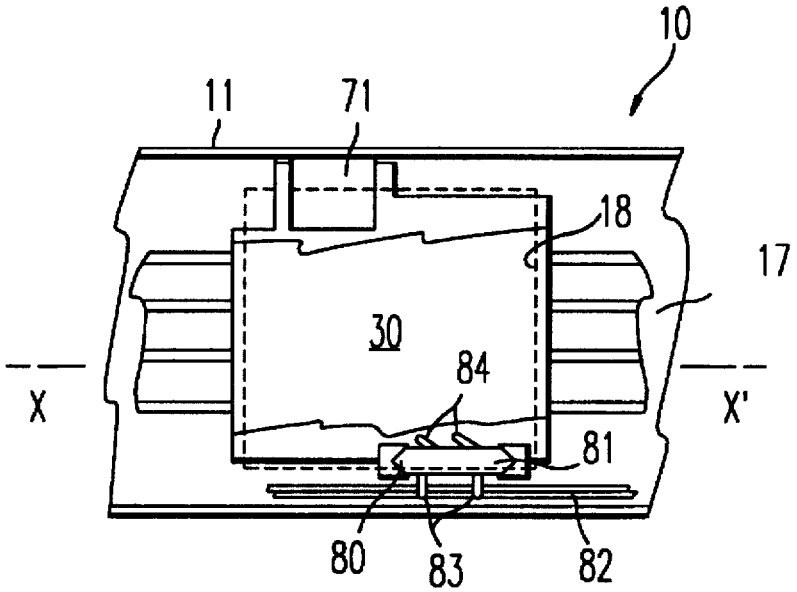
FIG. 7 is a top view of the contact block.

In the embodiment of the invention shown in FIGS. 5 through 7 the electrical trunking has support contact blocks which are different from those described previously. Similar parts are identified by the same reference numbers.

Each contact block 30 includes a first part 61 providing the housing 35 with its guide surfaces 35b, the flange 33 with its centering edge 33a which is bevelled in this embodiment and the guide finger 34a and the slots 36a and ribs 38 for retaining the conductors.

The contact block also has a second part 62 with ribs 63 for pressing bared areas 16a of the conductors 16 into the bottom of the slots 36a; the part 62 nests in, clips to or fixes by some like means to the first part 61. The second part 62 of the contact block has openings 64 at the side which are on a slant relative to Y–Y' and flanked by a notched or toothed elastic wall 65 cooperating with a complementary notched or toothed rack tongue 66. A tool inserted through the opening 18 in the enclosure and through an opening 68 in the part 61 of the contact block pushes in the direction B on the upper end 67 of each tongue so that the lower end 69 of the tongue moves down until it abuts against the inside face 15a of the wall 15 of the enclosure; at the same time, another tool is used to apply traction in the direction B' to the part 61 or 62 of the contact block to hold the centering edge 33a in the opening 18 or to move it there. When the teeth 66a of the rack tongue engaged in the teeth 65a of the elastic wall 65, the latter is constrained to move to the position shown in dashed outline in FIG. 6. The teeth have an oblique side and a side substantially parallel to P–P'. The tongues 66 are rigid but they can instead be elastic in themselves or provided with elastic means for complementing the elastic expansion device 30a. The combination of rack tongues and elastic walls produces an elastic force to clamp the contact block in the trunking.

The contact block has an elastic strip 71 for earthing the enclosure. This strip is similar to the strip 50 and can move from a sliding position (shown in dashed outline in FIG. 6) to an operative position in which one branch 72 is pressed against the side 13a of the wall 13 of the enclosure (shown in full outline in FIG. 5) by disengaging an area 73 of the strip by means of a tool facing a retaining shoulder 74 on the contact block.

A housing 80 in a lateral part of the contact block (FIG. 7) accommodates a sliding connection member 81 for making connections to low-current signal conductors 82 in the trunking parallel to the power conductor 16. These low current signal conductors can be twisted wires or screened twisted wires protected against electromagnetic interference. The member 81 has insulation displacement contacts 83 to make the connection to the conductors 82 which are fastened to or electrically connected to contact strips 84 adapted to be connected to corresponding conductive parts of the connector.

The electrical trunking as described is manufactured in the following manner.

The openings 18 are cut out from a sheet metal blank with the predetermined pitch L and the blank is bent along longitudinal generatrices to form the enclosure 11 with the edges 27, 28 forming a longitudinal crimp seam 26 which closes and seals the trunking. The exterior of the trunking is then painted by any of the usual means. The bundle 17 of conductors with the areas 16a bared beforehand is laid in the slots 36a of the moulded contact block bodies 32, 61 at the pitch L; in the example of FIGS. 3 and 4 the pivoting members are clipped into the lugs 39a of the contact blocks and are held in the retracted position enabling unimpeded insertion into the enclosure. The pivoting members hold the bundle 17 against or near the bottoms of the slots 36a. In the example of FIGS. 5 through 7 the part 62 is nested in or clipped against the part 61 to hold the areas 16a of the conductors at the bottom of the slots 36a. The contact blocks and cables are held in position in the direction of the X–X' axis by abutment of the cable sheaths 16b against the shoulders on the contact blocks.

The subassembly comprising the bundle 17 of conductors and the support contact blocks 30 is then inserted into the tubular enclosure 11 by pulling or pushing (preferably pulling) on a member at the end of the subassembly (not shown).

When each contact block has been positioned in front of its respective branch opening, a tool is inserted into each opening 18 to operate the expansion device. In the example of FIGS. 3 and 4 the member 40 is pivoted from its retracted position between the legs 34 to its deployed clamping position. The pivoting of the deformable part 42 displaces the contact block towards the opening 18, centres its rebated edge 33*a* in the opening and elastically clamps the cam against the inside face 15*a* of the wall 15. At the same time, the comb formed by the branches 43 is pressed against the bared parts 16*a* of the cables to hold them at the bottom of the slots and the lug 54 releases the earthing strip 50 so that it is pressed against the enclosure.

In the example of FIGS. 5 through 7 a tool is applied to the upper end 67 of each tongue (arrow B—FIG. 6), the contact block is pulled in the direction of the arrow B' and the conductor 71 is released.

The elastic effect of the pivoting member 40 or the tongues 66 take up play and tolerances.

The trunking described can accommodate two groups of conductors rather than a single group. A second bundle 17' between the legs 34 of the contact blocks 30 associated with the first bundle is shown in dashed outline in FIG. 4; the corresponding branch openings 18' are then in the wall 15 opposite the wall 12 and the corresponding contact blocks (30') are reversed. Branch connectors can then be fitted from both sides of the trunking to contact blocks disposed alternately along it.

It goes without saying that a member for centring the contact block relative to its respective branch opening can be attached from the outside, although this has the drawback that there is no longer a plane or substantially plane surface 12 at the branch connections. Other elastic retention expansion devices can be used instead of those described.

We claim:

1. Electrical trunking comprising:

a metal enclosure including plural branch openings;

a support contact block; and an expansion device including an operating member accessible and operable through one of the plural branch openings, the expansion device being operable by the operating member to press the support contact block against an inside face of the metal enclosure in a direction (Y–Y') perpendicular to a plane of the plural branch openings.

2. Electrical trunking according to claim 1 wherein the expansion device devices further comprises an elastic member coupled to the operating member to generate an elastic force for clamping the support contact block against an edge of a respective branch opening after operating the operating member.

3. Electrical trunking comprising:

a metal enclosure including plural branch openings;

a support contact block including a lateral opening and a wall having teeth which flanks the lateral opening; and an expansion device including at least one rack tongue, wherein the at least one rack tongue is inserted through one of the plural branch openings and through the lateral opening to press the support contact block against an inside face of the metal enclosure in a direction (Y–Y') perpendicular to a plane of the plural branch openings.

4. Electrical trunking according to claim 3, wherein the wall comprises an elastic wall having teeth.

5. Electrical trunking according to claim 3, wherein the rack tongue comprises an elastic rack tongue.

6. Electrical trunking according to claim 1, further comprising:

reversed support contact blocks, wherein the metal enclosure includes plural branch openings on opposite faces of the metal enclosure.

* * * * *